US007527762B2

(12) United States Patent
Hou et al.

(10) Patent No.: US 7,527,762 B2
(45) Date of Patent: May 5, 2009

(54) METHOD OF PRODUCING HEAT PIPE

(75) Inventors: Chuen-Shu Hou, Guangdong (CN); Chao-Nien Tung, Guangdong (CN); Tay-Jian Liu, Guangdong (CN)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 442 days.

(21) Appl. No.: 11/307,618

(22) Filed: Feb. 15, 2006

(65) Prior Publication Data

US 2007/0048165 A1 Mar. 1, 2007

(30) Foreign Application Priority Data

Aug. 26, 2005 (CN) ..... 2005 1 0036896

(51) Int. Cl.
*B22F 3/10* (2006.01)

(52) U.S. Cl. ..... 419/8; 419/5; 419/38; 29/890.032; 165/104.26

(58) Field of Classification Search ..... 419/8
See application file for complete search history.

(56) References Cited

U.S. PATENT DOCUMENTS 3,497,413 A * 2/1970 Hullhorst ..... 156/425
4,196,504 A * 4/1980 Eastman ..... 29/890.032
4,885,129 A * 12/1989 Leonard et al. ..... 419/2
5,028,363 A * 7/1991 Nishio et al. ..... 264/28
6,880,626 B2 * 4/2005 Lindemuth et al. ..... 165/104.26
6,994,152 B2 * 2/2006 Rosenfeld et al. ..... 165/104.21
7,472,479 B2 * 1/2009 Hou et al. ..... 29/890.032

* cited by examiner

*Primary Examiner*—Roy King
*Assistant Examiner*—Christopher Kessler
(74) *Attorney, Agent, or Firm*—Winston Hsu

(57) ABSTRACT

A method (100) of producing a heat pipe includes the following steps: (1) inserting a mandrel (10) into a hollow metal casing (20) with a space formed between the hollow metal casing and the mandrel; (2) filling into the space with a slurry (40) comprised of powders; (3) solidifying the slurry in the space; (4) drawing the mandrel out of the hollow metal casing after the slurry is solidified; and (5) sintering the powders contained in the slurry to form the heat pipe (60) with a sintered powder wick (61) arranged therein. In the sintering step of the method, no mandrel is required. Thus, the problem that the mandrel is difficult to be drawn out of the hollow metal casing as suffered in the conventional art is effectively solved.

8 Claims, 4 Drawing Sheets

METHOD OF PRODUCING HEAT PIPE

FIELD OF THE INVENTION

The present invention relates generally to heat pipes, and more particularly to a method of producing a heat pipe.

DESCRIPTION OF RELATED ART

Heat pipes have excellent heat transfer performance due to their low thermal resistance, and therefore are an effective means for transfer or dissipation of heat from heat sources. Currently, heat pipes are widely used for removing heat from heat-generating components such as central processing units (CPUs) of computers. A heat pipe is usually a vacuum casing containing therein a working fluid. Preferably, a wick structure is provided inside the heat pipe, lining an inner wall of the casing. The heat pipe has an evaporating section for receiving heat from a heat-generating component and a condensing section for releasing the heat absorbed by the evaporating section. When heat generated by a heat-generating component is inputted into the heat pipe via its evaporating section, the working fluid contained therein absorbs the heat and turns into vapor. Due to the difference of vapor pressure between the two sections of the heat pipe, the generated vapor moves, with the heat being carried, towards the condensing section where the vapor is condensed into condensate after releasing the heat into ambient environment by, for example, fins thermally contacting the condensing section. Due to the difference of capillary pressure developed by the wick structure between the two sections, the condensate is then drawn back by the wick structure to the evaporating section where it is again available for evaporation.

The wick structure currently available for the heat pipe includes fine grooves integrally formed in the inner wall of the casing, mesh or bundles of fiber inserted into the casing and held against the inner wall thereof, or sintered powders combined to the inner wall of the casing. As with the sintered powder wick, it commonly is made by using a sintering process. FIG. 4 illustrates a conventional sintering process used to make a sintered powder wick, in which a mandrel 81 is inserted into a hollow casing 82 of a heat pipe and powders 83 (typically copper powders) are filled into a space defined between the mandrel 81 and the casing 82. Then, the filled powders 83 together with the casing 82 are heated at a high temperature, whereby the filled powders 83 are sintered and diffusion bonded together to form the sintered powder wick.

In the above-mentioned sintering process, the filled powders 83 also have a diffusion bond with the mandrel 81, which is typically made of stainless steel material, at their contacting interface, i.e., an outer surface of the mandrel 81 and an inner peripheral layer of the filled powders 83 contacting the mandrel 81. Furthermore, if the filled powders 83 used to form the sintered powder wick are copper powders, they will expand by 2 to 3 percents in the temperature range of about 600 to 800 degrees centigrade during the sintering process. Thus, after the sintering process, it becomes difficult to draw the mandrel 81 out of the casing 82. If the mandrel 81 is forcibly drawn out, the casing 82 of the heat pipe will possibly be deformed due to such action to separate the mandrel 81 from the casing 82. In some cases, the heat pipe becomes useless since the mandrel 81 cannot be removed from the casing 82 or the casing 82 is severely deformed after the mandrel 81 is forcibly drawn out. Generally, the mandrel 81 can be used for about 10-50 times until it is not available for the sintering process and is abandoned.

In order to separate the mandrel 81 from the casing 82 more easily, prior to being inserted into the casing 82, the mandrel 81 typically is nitrogen-processed and a layer of heat-resistant material such as tungsten powders, boron nitride (BN) or aluminum oxide (Al2O3) is previously applied to the outer surface thereof so as to reduce an extent of diffusion bond between the mandrel 81 and the filled powders 83 in the sintering process. However, as the mandrel 81 is being removed out of the casing 82 after the sintering process, the heat-resistant material applied to the outer surface of the mandrel 81 could be scraped from the mandrel 81 and left within the casing 82 due to a friction between the mandrel 81 and the filled powders 83, in which case the heat-resistant material left will possibly block passages of the sintered powder wick formed by the sintering process. The blockage of the passages undermines the function of the wick structure for drawing the condensate back to the evaporating section from the condensing section of the heat pipe. On the other hand, the useful life span of the mandrel 81 is also significantly affected by the scrape of the heat-resistant material. According to a practical experience, a mandrel with boron nitride (BN) coated thereon can normally be used for about 5-8 times in the sintering process before the boron nitride is worn out. Then, a new layer of boron nitride needs to be applied on the outer surface of the mandrel. On this basis, the manufacturing cost of a sintered heat pipe produced in accordance with the conventional method is relatively high since the mandrel needs to be frequently replaced.

Therefore, it is desirable to provide a method of producing a heat pipe which overcomes the foregoing disadvantages.

SUMMARY OF INVENTION

The present invention relates to a method of producing a heat pipe. The method includes the following steps: (1) inserting a mandrel into a hollow metal casing with a space formed between the hollow metal casing and the mandrel; (2) filling into said space with a slurry comprised of powders; (3) solidifying the slurry in said space; (4) drawing the mandrel out of the hollow metal casing after the slurry is solidified; and (5) sintering the powders contained in the slurry to form the heat pipe with a sintered powder wick arranged therein.

In the present method, the mandrel has been drawn out of the hollow metal casing when the powders are sintered. The problem that the mandrel is difficult to be drawn out of the hollow metal casing as suffered in the conventional art is effectively solved. The manufacturing cost of the heat pipe produced by the present method is accordingly lowered down since the mandrel can be repeatedly used in theory with an unlimited number of times.

Other advantages and novel features of the present invention will become more apparent from the following detailed description of preferred embodiment when taken in conjunction with the accompanying drawings, in which:

DETAILED DESCRIPTION

Figure 1:
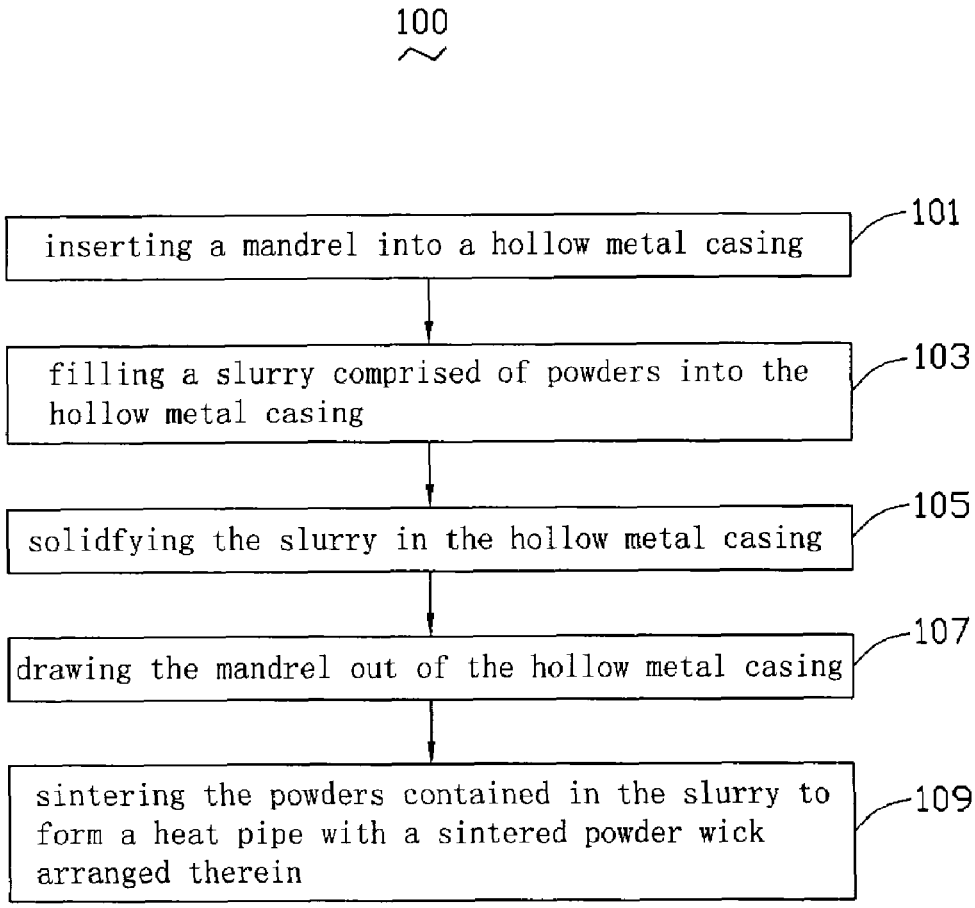
FIG. 1 is a flow chart showing a preferred method of the present invention used to produce a heat pipe.
Figure 2:
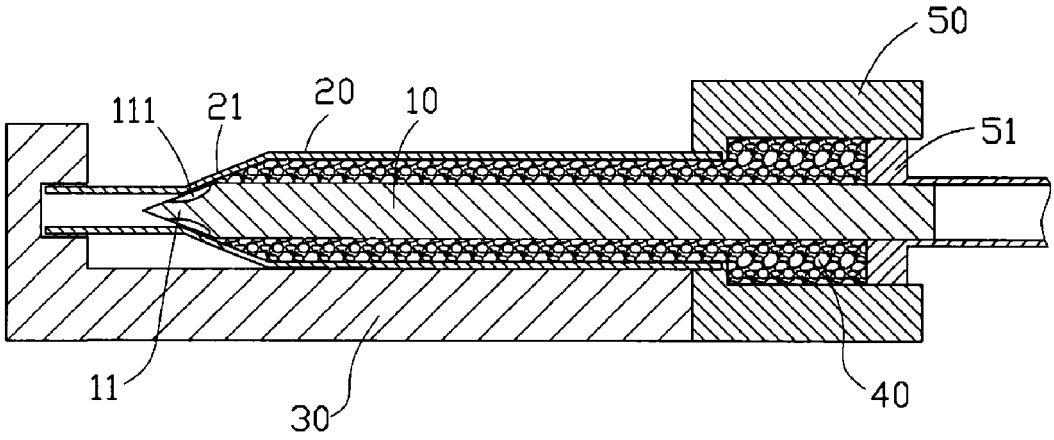
FIG. 2 is a longitudinal cross-sectional view illustrating the method of FIG. 1, in producing the heat pipe.
Figure 3:
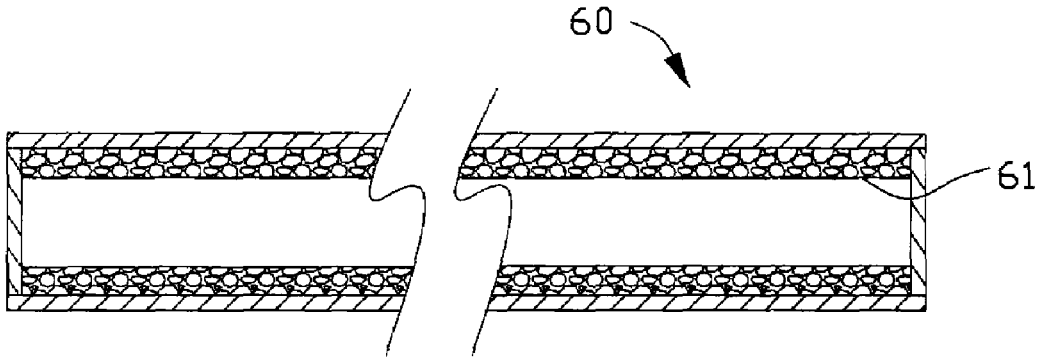
FIG. 3 is a longitudinal cross-sectional view of the heat pipe produced according to the method of FIG. 1.
Figure 4:
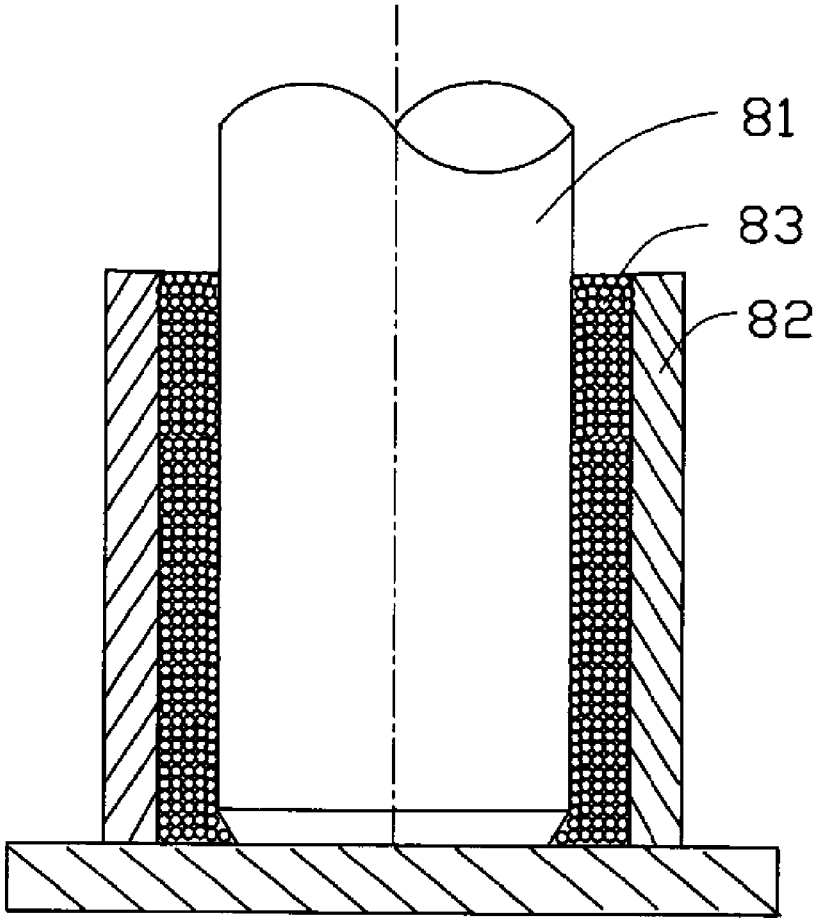
FIG. 4 (RELATED ART)
FIG. 4 a view illustrating the conventional sintering process in producing a heat pipe.

FIG. 1 is a flow chart showing a preferred method 100 of the present invention adopted for manufacturing a heat pipe. With reference also to FIGS. 2-3, an example is shown to produce the heat pipe by using the method 100. With respect to the step 101, a mandrel 10 is firstly inserted into a hollow metal casing 20, which is seated on a positioning block 30 (step 101), as illustrated in FIG. 2. The mandrel 10 has a smaller diameter than that of the hollow metal casing 20 so that a space (not labeled) is formed between the hollow metal casing 20 and the mandrel 10 after the mandrel 10 is inserted into the hollow metal casing 20. The hollow metal casing 20 is made of high thermally conductive material such as copper or aluminum.

Then, a slurry 40, as will be described in more detail below, is injected from a container 50 in which the slurry 40 is contained into the space formed between the hollow metal casing 20 and the mandrel 10 by pushing a piston 51 of the container 50, which in turn, pushes the slurry 40 contained in the container 50 into the space formed in the hollow metal casing 20 (step 103). A distal end 21 of the hollow metal casing 20 has a tapered configuration in order to retain the filled slurry 40 in the hollow metal casing 20. Similarly, a front end 11 of the mandrel 10 also has a tapered configuration so that the front end 11 of the mandrel 10 firmly engages with the distal end 21 of the hollow metal casing 20 after the mandrel 10 is inserted into the hollow metal casing 20. The front end 11 of the mandrel 10 defines a plurality of holes 111 in a periphery thereof. Due to the presence of the holes 111, the air originally in the hollow metal casing 20 is capable of escaping the hollow metal casing 20 through these holes 111 during the injection of the slurry 40 into the hollow metal casing 20.

After the space formed between the hollow metal casing 20 and the mandrel 10 is filled with the slurry 40, the slurry 40 is solidified therein (step 105). The slurry 40 is obtained by mixing thermally conductive powders, for example, metal powders or ceramic powders, with a solvent, a binder and, if desirable, some other additives. These components are mixed together in a certain proportion either by weight or by volume so that the slurry 40 has a suitable viscosity. The powders are preferably made of copper, aluminum, silver, nickel, titanium, diamond or ceramics, or combination thereof. The solvent, which is used to lower the viscosity of the slurry 40 so that the slurry 40 can flow more easily, may be selected from water or organic material such as alcohol, ketone, xylene, aryl derivatives or the like. The binder, which is used to combine the powders together, may be selected from polyvinyl alcohol (PVA), polyvinyl butyral (PVB), acrylic resin or the like. Other additives that are desirable may include a dispersant to stabilize the powders against colloidal forces. The dispersant may be selected from fish oil such as menhaden fish oil. In this situation, for purpose of solidification, the hollow metal casing 20 is heated to volatilize the solvent whereby the slurry 40 is solidified.

Alternatively, the slurry 40 may also be obtained by mixing the necessary powders with a macromolecular material and a binder binding the powders with the macromolecular material. The macromolecular material is typically selected from such materials having a low melting temperature as plastics, or paraffins. In this situation, the slurry 40 is filled into the hollow metal casing 20 when the macromolecular material is at a molten state. The macromolecular material solidifies in the hollow metal casing 20 when it is cooled.

After the slurry 40 is solidified in the hollow metal casing 20, the filled powders are temporarily bonded together by the binder contained in the slurry 40, and secured within the hollow metal casing 20. Then, the mandrel 10 is drawn out of the hollow metal casing 20 (step 107). The hollow metal casing 20 with the solidified slurry 40 therein is placed into an oven (not shown) and is heated under a high temperature, for example, about 500~1000 degrees Celsius if the filled powders 40 are copper powders, to cause the powders to be sintered and diffusion bonded together (step 109). In this sintering step 109, the temperature in the oven is preferably increased gradually in order to prevent a collapse of the powders from the hollow metal casing resulted from the immediate disappearance of the binder and the other additives in the solidified slurry 40. After this sintering step 109, a working fluid such as water, alcohol, methanol, or the like, is injected into the hollow metal casing 20, and finally, the hollow metal casing 20 is vacuumed and two ends of the hollow metal casing 20 are hermetically sealed so as to form a heat pipe 60 with a sintered powder wick 61 arranged therein, as shown in FIG. 3.

In the present method 100, the mandrel 10 used to held the filled slurry 40 in place has been drawn out of the hollow metal casing 20 when the sintering step 109 is carried out. In the sintering step 109, no mandrel is required. Thus, the problem that the mandrel is difficult to be drawn out as suffered in the conventional art is effectively solved. As a result, the mandrel 10 can be used continuously and the manufacturing cost of each heat pipe 60 produced by the present method 100 is lowered down.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for forming a heat pipe comprising:

inserting a mandrel into a hollow metal casing so that a space is defined between the mandrel and the casing, wherein the mandrel has a tapered end engaging with a tapered end of the hollow metal casing, the mandrel having at least a hole in the tapered end thereof;

injecting a slurry comprising a plurality of powders therein into the space during which air in the space leaves the space through the at least a hole;

solidifying the slurry;

withdrawing the mandrel from the hollow metal casing;

heating the hollowing metal casing and the solidified slurry to sinter the powders;

injecting working fluid into the hollow metal casing; and vacuuming and sealing the hollow metal casing.

2. The method of claim 1, wherein the slurry is injected into the space by pushing a piston to drive the slurry into the space.

3. The method of claim 1, wherein the slurry, in addition to the powders, comprises solvent, binder and dispersant.

4. The method of claim 1, wherein the powders are metal powders.

5. The method of clam 4, wherein the powders are copper powders.

6. The method of claim 3, wherein the solvent is one of water, alcohol, ketone and aryl derivatives.

7. The method of claim 6, wherein the binder is one of polyvinyl alcohol (PVA), polyvinyl butyral (PVB) and acrylic resin.

8. The method of claim 7, wherein the dispersant is fish oil.

* * * * *